United States Patent [19]

Hoskins

[11] 4,033,205

[45] July 5, 1977

[54] WRENCH FOR CONTAINER CLOSURES

[76] Inventor: Nathan D. Hoskins, 6 Maywood Drive, Jackson, Tenn. 38301

[22] Filed: June 4, 1976

[21] Appl. No.: 692,860

[52] U.S. Cl. ..... 81/3.42
[51] Int. Cl.[2] ..... B67B 7/18
[58] Field of Search ..... 81/3.42, 128

[56] References Cited

UNITED STATES PATENTS 2,521,011 9/1950 Hoskins ..... 81/3.42

FOREIGN PATENTS OR APPLICATIONS 429,761 6/1926 Germany ..... 81/3.42

*Primary Examiner*—Al Lawrence Smith
*Assistant Examiner*—Roscoe V. Parker
*Attorney, Agent, or Firm*—Young & Thompson

[57] ABSTRACT

A wrench for container closures such as jar caps and bottle caps comprises a supporting plate and an operating plate that is turned relative to the supporting plate by a handle. The operating plate has arcuate cam slots in which ride projecting portions of opposed oppositely moving grippers such that upon rotation of the handle and operating plate, the grippers are drawn toward or moved away from each other. The grippers are of two-part stamped metal construction, one part having stamped clips that ride in slots in the supporting plate to guide the grippers and also having stamped portions that ride in the arcuate cam slots of the operating plate; while the other gripper part is of stepped construction to provide a plurality of flanges for different sized jar caps and has on its inner edge teeth for gripping a bottle cap.

9 Claims, 8 Drawing Figures

WRENCH FOR CONTAINER CLOSURES

The present invention relates to wrenches for container closures such as jar caps and bottle caps, and is an improvement on my earlier U.S. Pat. No. 2,521,011, Sep. 5, 1950.

In my earlier patent, the disclosure which is incorporated herein by reference, I provided a cam-operated jar cap wrench having opposed grippers with upstanding flanges which coacted to grasp between them or to release a jar cap upon rotation of the handle. The device of that patent, however, had several disadvantages; and it is an object of the present invention to overcome those disadvantages. One of the disadvantages was that the range of diameters of jar caps that could be grasped by my earlier wrench was relatively limited. Another disadvantage was that certain features of construction were difficult and expensive to produce on a commercial scale.

Accordingly, it is an object of the present invention to provide a wrench for container closures, which will be usable with closures having a wide range of diameters and will be useful with bottle caps as well as jar caps.

Another object of the present invention is the provision of such a wrench, which will be relatively simple and inexpensive to manufacture and which will be rugged and durable in use.

Briefly, the objects of the invention are achieved, and the construction of the wrench of my above-identified patent is improved, by maintaining the basic arrangement of a supporting plate and a relatively rotatable operating plate turned by a handle that passes through the supporting plate, the operating plate having arcuate cam slots therein for moving grippers toward and away from each other, the grippers being supported for opposite reciprocatory sliding movement on the supporting plate; but instead of the construction of the grippers provided in my earlier patent, I have now discovered a new construction of gripper which is characterized by a number of features of novelty. In the first place, my new gripper is of two-part construction and can be die stamped from sheet metal, with the parts then being spot welded together to assemble the two parts of the gripper on opposite sides of the operating plate. One of those parts, the part that is disposed between the operating plate and the supporting plate, has clips stamped from the material of the part, these clips riding in diametral slots in the supporting plate and thus replacing a corresponding part on my earlier wrench which was more difficult and more expensive to produce. The other part of the gripper, which is disposed on the opposite side of the operating plate from the first part of the gripper, is of stepped construction and provides accordingly a plurality of flanges spaced at different distances from the axis of rotation thereby to broaden the range of diameters of closure that can be grasped by my new wrench. This second part at its radially inner end has teeth for grasping a closure of small diameter such as a bottle cap, and at this same end receives a die stamped upstanding portion of the first part that rides in the arcuate cam slot of the operating plate and thus replaces a part of my earlier gripper which was both difficult and expensive to produce and assemble.

Other objects, features and advantages of the present invention will become apparent from a consideration of the following description, taken in connection with the accompanying drawing, in which.

Figure 1:
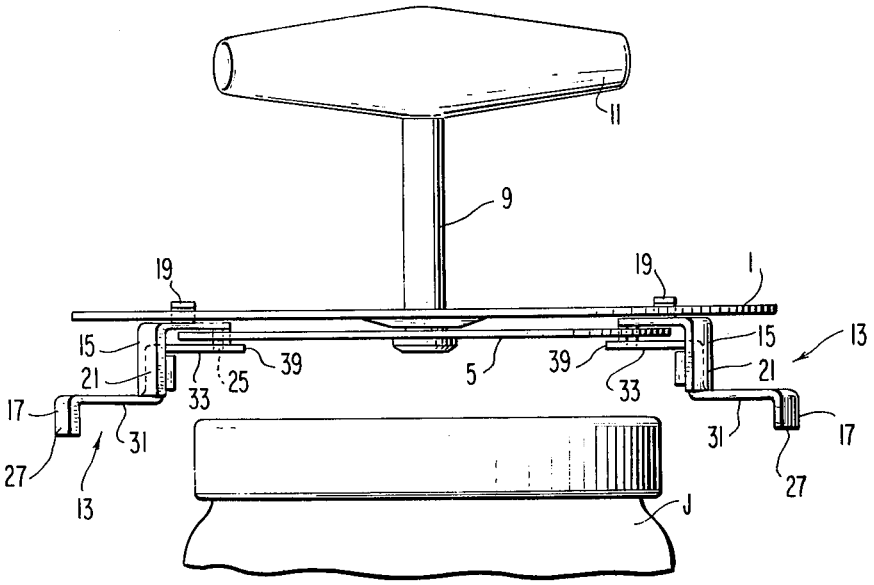
FIG. 1 is an exploded side elevational view of a jar and a wrench according to the present invention, showing the orientation of these parts to each other.
Figure 2:
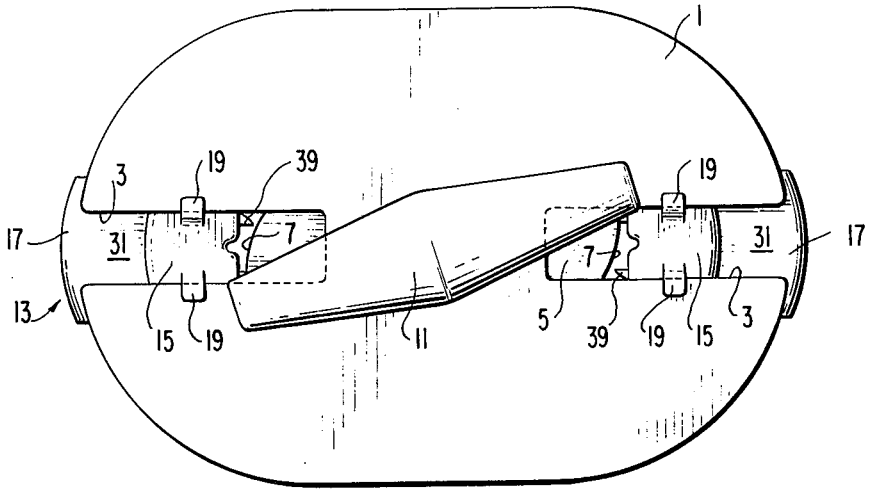
FIG. 2 is a top plan view of the wrench of my invention.

Referring now to the drawing in greater detail, there is shown in FIG. 1 a wrench according to the present invention, for removal of the closure of, for example, a jar J by placing the wrench over the closure and then turning the handle of the wrench in a direction to unscrew the closure, or for replacement of the closure by the reverse operation. In this regard, the present wrench operates largely as my previous wrench, disclosed in my above-identified earlier patent.

Thus, my new wrench, in common with my earlier wrench, comprises a supporting plate 1 of heavy gauge sheet metal having a pair of diametrical aligned slots 3 therein that open oppositely outwardly through the ends of plate 1 but terminate inwardly short of the center of the plate. An operating plate 5 is provided on the underside of plate 1 parallel thereto and has cam slots 7 therein closed at both ends and arcuate in such a manner that the ends of the slots are closer to the center of the plate than are the mid-portions of the slots, in the same manner and for the same purposes as in my earlier patent. A shaft 9 perpendicular to plates 1 and 5 passes rotatably through plate 1 and is fixedly secured to plate 5; and a handle 11 at the end of shaft 9 opposite plate 5 is provided for rotating plate 5 relative to plate 1. A pair of oppositely reciprocable grippers 13 are thus moved toward or away from each other by turning handle 11 to rotate plate 5, in the manner previously described.

Thus far, the structure of my new wrench can be generally the same as that of the old. It is principally as to the grippers 13, however, that the new wrench differs from and is an improvement over the old.

In the present invention, the grippers 13 are of two-part construction, each part being die stamped from relatively heavy gauge sheet metal and the two parts being secured together as by spot welding. Thus, there are two parts 15 and 17 of each gripper 13, the part 15 being disposed between the plates 1 and 5 and the part 17 being disposed on the opposite side of plate 5 from part 15.

Figure 4:
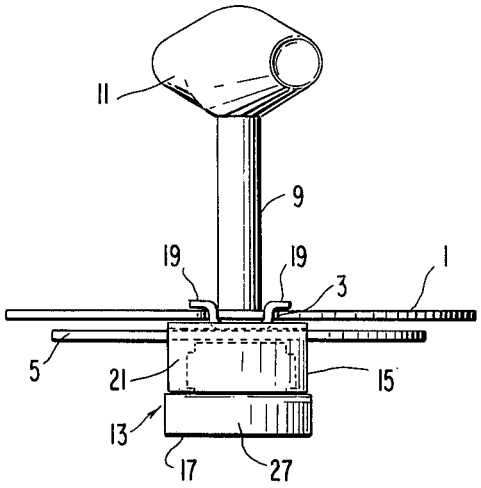
FIG. 4 is an end elevational view thereof.
Figure 5:
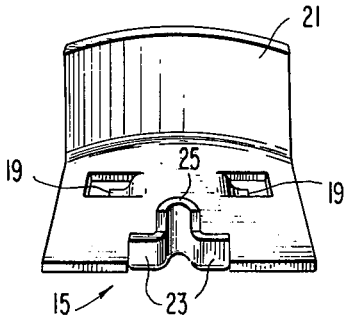
FIG. 5 is a top perspective view of one part of the two-part gripper of the invention.
Figure 6:
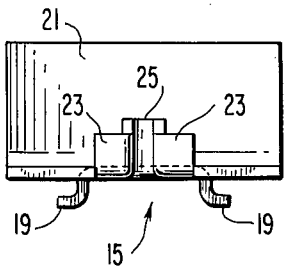
FIG. 6 is an elevational view of the structure shown in FIG. 5, as viewed in a direction looking outward from the axis of rotation of the wrench.

The part 15 is best seen in FIGS. 5 and 6 and is generally L-shaped, comprising a horizontal portion from which are die stamped a pair of oppositely extending clips 19 from the material of the part itself. Clips 19 ride in slots 3 in plate 1, in the manner best seen in FIG. 4, each clip 19 slidably receiving an edge of a slot 3 between the clip 19 and the remainder of part 15 from which clip 19 was stamped. The slots 3 of the present invention are thus somewhat wider than the corresponding slots in the device disclosed in my earlier patent; and the clips 19 thus replace the corresponding more expensive headed slide members shown in my earlier patent.

Part 15 also has an arcuate flange 21 along its radially outer edge; and along its radially inner edge, part is has turned-up portions 23 and 25. Flange 21 and turned-up portions 23 and 25, like clips 19, are formed by die stamping. Turned-up portions 23 are disposed one on either side of turned-up portion 25 and are relatively low in height; while turned-up portion 25 is relatively high and is arcuate and is disposed in the adjacent slot 7 of operating plate 5 and replaces the corresponding headed rivet or pin of my earlier patent, with corresponding economy in production and assembly.

Figure 7:
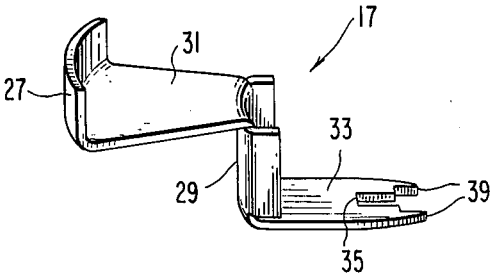
FIG. 7 is a top perspective view of the second part of the gripper.
Figure 8:
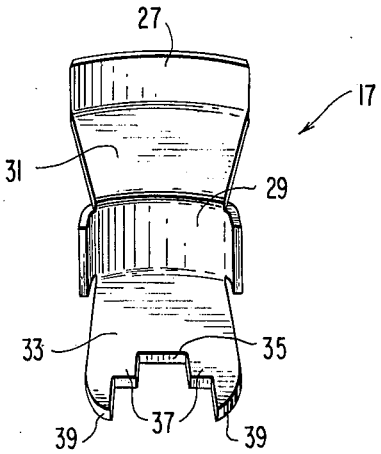
FIG. 8 is a top perspective view of the part shown in FIG. 7, but viewed in a direction radially outward of the axis of rotation of the wrench.

Part 17 of gripper 13 is best seen in FIGS. 7 and 8 and is of generally stepped construction, with a radially outer flange 27 and a radially inner flange 29 interconnected by a horizontal step 31. Flanges 27 and 29 extend generally parallel to the axis of shaft 9. Radially inwardly of flange 29, part 17 is provided with a horizontal portion 33 that has at its inner end a recess 35 that receives turned-up portion 25 of part 17, as well as shoulders 37 on each side or recess 35 that rest on the edges of turned-up portions 23. Teeth 39 are provided on either side of shoulders 37 of part 17, for gripping a relatively small closure such as a bottle cap.

Figure 3:
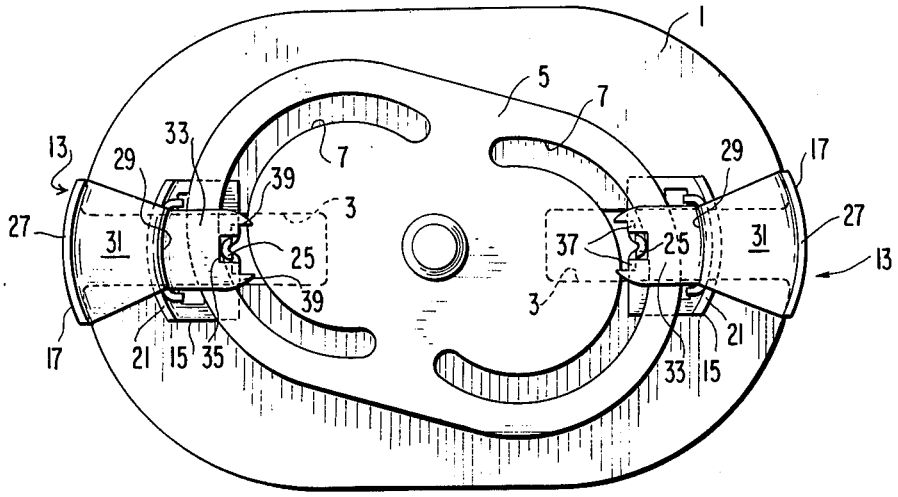
FIG. 3 is a bottom plan view thereof.

Parts 15 and 17 are thus interengaged at 23, 25, 35 and 37; and also, flange 21 on part 15 receives within it the correspondingly arcuate flange 29 of part 17 with step 31 of part 17 resting on the edge of flange 21 of part 15. These interengaging regions of parts 15 and 17 are spot welded together in the assembled position of the parts shown in FIGS. 1 and 3, thereby to secure the parts of the wrench in permanent assembly.

As indicated above, turning handle 11 operates the wrench in generally the same way as my previous wrench; but in the present wrench, there is now the opportunity to act on closures of a much wider range of diameter than was possible with the previous wrench. Thus, the largest closures can be received between the flanges 27; closures of medium diameter can be grasped between the flanges 29; while the smallest closures such as bottle caps can be grasped between the teeth 39. The stepped construction of part 17, best seen in FIG. 7, makes it possible to select which of the sets of coacting gripping surfaces will be used, according to the diameter of the closure to be acted upon.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the preview and scope of the present invention as defined by the appended claims.

What is claimed is:

1. In a wrench for container closures, comprising a supporting plate, an operating plate parallel to and disposed on one side of said supporting plate, a shaft passing rotatably through said supporting plate and fixed to said operating plate, a handle on said shaft on the side of said supporting plate opposite said operating plate, and a pair of opposed grippers that slide toward and away from each other on the side of said supporting plate opposite said handle and that engage slidably in arcuate slots in said operating plate whereby rotation of said handle moves said grippers toward and away from each other; the improvement in which said grippers are of two-part sheet metal construction, with the parts of each gripper being fixedly secured to each other one on one side of said operating plate between said operating plate and said supporting plate and the other on the side of said operating plate opposite said supporting plate, said grippers being of stepped construction having gripping surfaces extending generally parallel to the axis of the shaft and spaced at different radial distances from the axis of the shaft thereby to grip container closures of different diameters.

2. A wrench as claimed in claim 1, said gripping surfaces being comprises by a plurality of flanges on said other part of said gripper.

3. A wrench as claimed in claim 1, and a horizontal step between said flanges.

4. A wrench as claimed in claim 3, said one part of said gripper having an unstanding flange that engages behind one of said flanges of said other part and bears with its free edge against said step.

5. A wrench as claimed in claim 1, said other part having radially inwardly extending teeth on its radially inner end thereby to engage relatively small container closures.

6. In a wrench for container closures, comprising a supporting plate, an operating plate parallel to and disposed on one side of said supporting plate, a shaft passing rotatably through said supporting plate and fixed to said operating plate, a handle on said shaft on the side of said supporting plate opposite said operating plate, and a pair of opposed grippers that slide toward and away from each other on the side of said supporting plate opposite said handle and that engage slidably in arcuate slots in said operating plate whereby rotation of said handle moves said grippers toward and away from each other; the improvement in which said grippers are of two-part sheet metal construction, with the parts of each gripper being fixedly secured to each other one on one side of said operating plate between said operating plate and said supporting plate and the other on the side of said operating plate opposite said supporting plate, said other part having radially inwardly extending teeth on its radially inner end thereby to engage relatively small container closures, one of said parts having thereon a flange spaced radially outwardly from said teeth thereby to engage relatively large container closures, whereby said wrench is usable with container closures having a wide range of diameters.

7. A wrench as claimed in claim 6, said one part having a pair of oppositely extending clips that extend through a slot in said supporting plate and that guide the associated gripper for rectilinear sliding movement relative to said supporting plate.

8. A wrench as claimed in claim 6, said one part of said gripper having an upstanding portion that extends through a said arcuate slot in said operating plate and that engages the other said part of said gripper.

9. A wrench as claimed in claim 8, said upstanding part being a die shaped arcuate portion of the sheet metal of said one part.

* * * * *